US008753187B2

(12) United States Patent
Nicely

(10) Patent No.: US 8,753,187 B2
(45) **Date of Patent: *Jun. 17, 2014**

(54) STATE-BASED POWER-UPS

(75) Inventor: Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 225 days.

This patent is subject to a terminal disclaimer.

(21) Appl. No.: 13/250,790

(22) Filed: Sep. 30, 2011

(65) Prior Publication Data

US 2013/0084954 A1 Apr. 4, 2013

(51) Int. Cl.
*G07F 17/32* (2006.01)

(52) U.S. Cl.
CPC ..... *G07F 17/32* (2013.01); *G07F 17/326* (2013.01); *G07F 17/3262* (2013.01); *G07F 17/3267* (2013.01)
USPC ..... 463/16

(58) Field of Classification Search
CPC ... G07F 17/32; G07F 17/326; G07F 17/3262; G07F 17/3267
USPC ..... 463/16
See application file for complete search history.

(56) References Cited

U.S. PATENT DOCUMENTS

| | | | | |
|---|---|---|---|---|
| 5,833,537 | A | 11/1998 | Barrie | |
| 6,605,001 | B1 | 8/2003 | Tarantino | |
| 2004/0048650 | A1 | 3/2004 | Mierau et al. | |
| 2006/0035699 | A1 | 2/2006 | Falciglia, Sr. | |
| 2006/0189377 | A1 * | 8/2006 | Gomez et al. | 463/20 |
| 2006/0258422 | A1 | 11/2006 | Walker et al. | |
| 2008/0113779 | A1 | 5/2008 | Cregan | |
| 2008/0318668 | A1 | 12/2008 | Ching et al. | |
| 2010/0062840 | A1 | 3/2010 | Herrmann | |
| 2010/0197377 | A1 | 8/2010 | Aoki et al. | |

* cited by examiner

*Primary Examiner* — Corbett B Coburn
(74) *Attorney, Agent, or Firm* — Foley & Lardner LLP

(57) ABSTRACT

Disclosed herein are techniques and equipment for providing state-based power-ups to a wagering game player. The state-based power-ups may be reused by the player until a game outcome condition is not met.

20 Claims, 6 Drawing Sheets

STATE-BASED POWER-UPS

CROSS-REFERENCE TO RELATED APPLICATIONS

This application is related to U.S. patent application Ser. No. 13/250,775, entitled "STATE-BASED POWER-UPS" and filed on Sep. 30, 2011, and is also related to U.S. patent application Ser. No. 13/250,778, entitled "STATE-BASED POWER-UPS" and filed on Sep. 30, 2011, and is also related to U.S. patent application Ser. No. 13/250,782, entitled "STATE-BASED POWER-UPS" and filed on Sep. 30, 2011, and is also related to U.S. patent application Ser. No. 13/250,788, entitled "STATE-BASED POWER-UPS" and filed on Sep. 30, 2011, and is also related to U.S. patent application Ser. No. 13/250,795, entitled "STATE-BASED POWER-UPS" and filed on Sep. 30, 2011, and is also related to U.S. patent application Ser. No. 13/250,802, entitled "STATE-BASED POWER-UPS" and filed on Sep. 30, 2011, and is also related to U.S. patent application Ser. No. 13/250,808, entitled "STATE-BASED POWER-UPS" and filed on Sep. 30, 2011, and is also related to U.S. patent application Ser. No. 13/250,817, entitled "WAGER GAMING VOTING LEADERBOARD" and filed on Sep. 30, 2011, and is also related to U.S. patent application Ser. No. 13/250,835, entitled "WAGER GAMING VOTING LEADERBOARD" and filed on Sep. 30, 2011, all of which are hereby incorporated by reference and for all purposes.

TECHNICAL FIELD

The present disclosure relates generally to wager-based gaming machines, and more specifically to state-based power-ups for use in wager-based gaming systems.

BACKGROUND

Entities offering wager gaming may provide various incentives to induce players to engage in continued or increased revenue-generating game play. For example, player tracking systems may be used to encourage a player to play more by rewarding them for achievements during game play. In another example, players may be rewarded with bonus games which offer new and exciting game play opportunities.

SUMMARY

In some implementations, a state-based power-up management server is provided. The state-based power-up management server may include a communications interface, a memory, and a logic device, the logic device, the memory, and the communications interface operably connected and configured to receive a first input via the communications interface indicating that a state-based power-up has been redeemed for an in-game advantage at a first time during wagering game play and that a game outcome condition has been met in association with the redemption of the state-based power-up at the first time and determine, responsive to receipt of the first input, that an association of the state-based power-up with a player is to be maintained as a result of the game outcome condition being met in association with the redemption of the state-based power-up at the first time. The logic device, the memory, and the communications interface may be further configured to maintain, responsive to the determination that the association of the state-based power-up with the player is to be maintained, the association of the state-based power-up with the player in a database stored in the memory at least until a second input is received via the communications interface indicating that the state-based power-up has been redeemed for the in-game advantage at a second time later than the first time. The state-based power-up may be re-usable if a game outcome condition is met and the in-game advantage may provide an opportunity to improve a score or chances of winning within a game.

In some implementations, the logic device, the memory, and the communications interface may be further configured to receive the second input via the communications interface, the second input further indicating that the game outcome condition has not been met in association with the redemption of the state-based power-up at the second time and determine, responsive to receipt of the second input, that the state-based power-up is to be disassociated from the player as a result of the game outcome condition not being met in association with the redemption of the state-based power-up at the second time. The logic device, the memory, and the communications interface may also be further configured to disassociate, responsive to the determination that the state-based power-up is to be disassociated from the player, the state-based power-up from the player in the database stored in the memory and communicate, to a wager gaming machine and via the communications interface, that the state-based power-up has been disassociated from the player in response to receiving the second input.

In some implementations, the logic device, the memory, and the communications interface may be further configured to receive, via the communications interface, one or more additional inputs indicating that the state-based power-up has been redeemed at one or more additional times between the first time and the second time for the in-game advantage and that the game outcome condition has been met in association with each of the redemptions of the state-based power-up at the one or more additional times and determine, responsive to receipt of the one or more additional inputs, that the association of the state-based power-up with the player is to be maintained as a result of the game outcome condition being met in association with the redemption of the state-based power-up at the one or more additional times. The logic device, the memory, and the communications interface may also be further configured to maintain the association of the state-based power-up with the player in the database stored in the memory until the second input is received.

In some implementations, the logic device, the memory, and the communications interface may be further configured to evaluate data included in the first input to determine that the game outcome condition has been met. In some implementations, the first input may include a determination by a wager gaming machine that the game outcome condition has been met, and the logic device, the memory, and the communications interface may be further configured to determine that the association of the state-based power-up with a player is to be maintained based on the determination by the wager gaming machine. In some implementations, the logic device, the memory, and the communications interface may be further configured to retrieve data regarding the in-game advantage from the database and communicate the data regarding the in-game advantage to a wager gaming machine.

In some implementations, the logic device, the memory, and the communications interface may be further configured to change the in-game advantage during the wagering game play and communicate data indicating the changed in-game advantage to the wager gaming machine via the communications interface. In some implementations, the logic device, the memory, and the communications interface may be further configured to change the in-game advantage between wagering game play on a second wager gaming machine and the wagering game play on the wager gaming machine, the wagering game play on the second gaming machine different than the wagering game play on the wager gaming machine, and communicate data indicating the changed in-game advantage to the wager gaming machine via the communications interface.

In some implementations, the logic device, the memory, and the communications interface may be further configured to disassociate the state-based power-up from the player in the database by changing a flag in a record linking the state-based power-up with the player. In some other implementations, the logic device, the memory, and the communications interface may be further configured to disassociate the state-based power-up from the player in the database by deleting a record in the database linking the state-based power-up with the player.

In some implementations, computer software embodied in a machine-readable medium may be provided. The computer software may include instructions for controlling devices in a gaming network, the gaming network including a server, a storage device communicatively connected to the server, and a gaming machine, to receive, by the server, a first input from the gaming machine via the gaming network indicating that a state-based power-up has been redeemed for an in-game advantage at a first time during wagering game play provided by the wager gaming machine and that a game outcome condition has been met in association with the redemption of the state-based power-up at the first time. The computer software may include further instructions for controlling the devices in the gaming network to determine, by the server and responsive to receipt of the first input by the server, that an association of the state-based power-up with a player is to be maintained as a result of the game outcome condition being met in association with the redemption of the state-based power-up at the first time, and maintain, by the server and responsive to the determination that the association of the state-based power-up with the player is to be maintained, the association of the state-based power-up with the player in a database stored on the storage device at least until a second input is received via the communications interface indicating that the state-based power-up has been redeemed for the in-game advantage at a second time later than the first time. The state-based power-up may be re-usable if a game outcome condition is met, and the in-game advantage may provide an opportunity to improve a score or chances of winning within a game.

In some implementations, the computer software may further include instructions for controlling the devices in the gaming network to receive, by the server, the second input via the gaming network indicating that the state-based power-up has been redeemed for the in-game advantage at the second time, the second input further indicating that the game outcome condition has not been met in association with the redemption of the state-based power-up at the second time and determine, by the server and responsive to receipt of the second input, that the state-based power-up is to be disassociated from the player as a result of the game outcome condition not being met in association with the redemption of the state-based power-up at the second time. The computer software may also further include instructions for controlling the devices in the gaming network to disassociate, by the server and responsive to the determination that the state-based power-up is to be disassociated from the player, the state-based power-up from the player in the database stored on the storage device and transmit, from the server and via the gaming network, information indicating that the state-based power-up has been disassociated from the player in response to receiving the second input.

In some implementations, the computer software may further include instructions for controlling the devices in the gaming network to receive, by the server, one or more additional inputs indicating that the state-based power-up has been redeemed at one or more additional times between the first time and the second time for the in-game advantage and that the game outcome condition has been met in association with each of the redemptions of the state-based power-up at the one or more additional times and determine, by the server and responsive to receipt of the one or more additional inputs, that the association of the state-based power-up with the player is to be maintained as a result of the game outcome condition being met in association with the redemption of the state-based power-up at the one or more additional times. The computer software may also further include instructions for controlling the devices in the gaming network to maintain, by the server, the association of the state-based power-up with the player in the database stored on the storage device until the second input is received.

In some implementations, the computer software may further include instructions for controlling the devices in the gaming network to determine that the game outcome condition has been met. In some implementations, the computer software may further include instructions for controlling the server to determine that the association of the state-based power-up with a player is to be maintained based on the determination by the wager gaming machine. In some implementations, the computer software may further include instructions for controlling the server to retrieve data regarding the in-game advantage from the database and communicate the data regarding the in-game advantage to the wager gaming machine.

In some implementations, the computer software may further include instructions for controlling the server to change the in-game advantage during the wagering game play and communicate data indicating the changed in-game advantage to the wager gaming machine or a second gaming machine via the communications interface.

In some implementations, the computer software may further include instructions for controlling the server to change the in-game advantage between the wagering game play on the wager gaming machine and wagering game play on a different wager gaming machine, the wagering game play on the different gaming machine different than the wagering game play on the wager gaming machine, and communicate data indicating the changed in-game advantage to the different wager gaming machine via the communications interface.

In some implementations, the computer software may further include instructions for controlling the server to disassociate the state-based power-up from the player in the database by changing a flag in a record linking the state-based power-up with the player. In some other implementations, the computer software may further include instructions for controlling the server to disassociate the state-based power-up from the player in the database by deleting a record in the database linking the state-based power-up with the player.

BRIEF DESCRIPTION OF THE DRAWINGS

The included drawings are for illustrative purposes and serve only to provide examples of possible structures and process steps for the disclosed inventive systems, methods, and apparatuses for providing state-based power-up systems for wagering game play. These drawings in no way limit any changes in form and detail that may be made to implementations of the techniques, systems, and devices disclosed herein by one skilled in the art without departing from the spirit and scope of the disclosure.

DETAILED DESCRIPTION

Although the following text sets forth a detailed description of numerous different embodiments, it should be understood that the legal scope of the invention is defined by the words of the claims set forth at the end of this patent. The detailed description is to be construed as an example only and does not describe every possible embodiment since describing every possible embodiment would be impractical, if not impossible. Numerous alternative embodiments may be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1A:
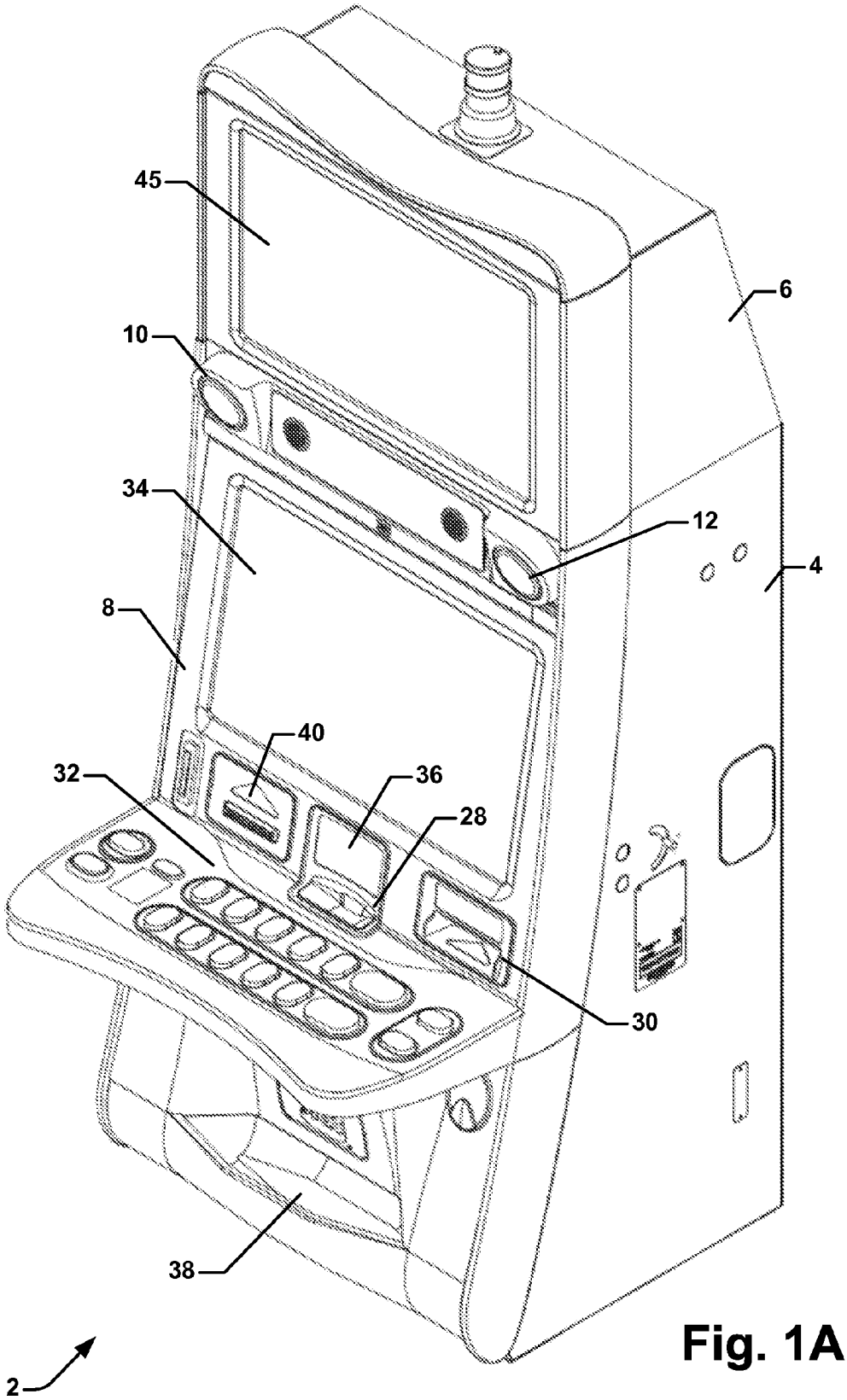
FIGS. 1A-1C depict isometric, front, and side views, respectively, of a wagering game machine which may be used in the techniques described below.
Figure 1B:
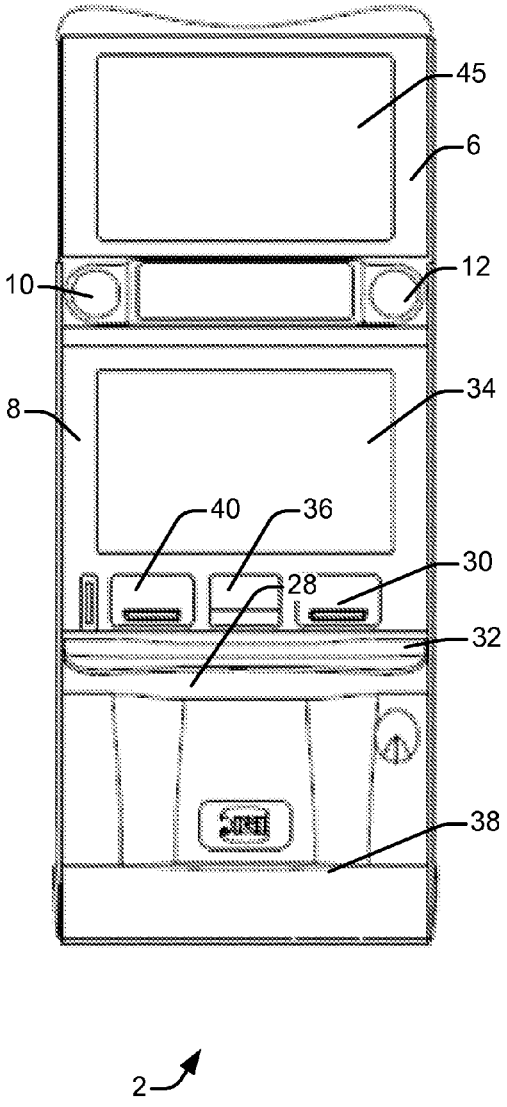
Figure 1C:
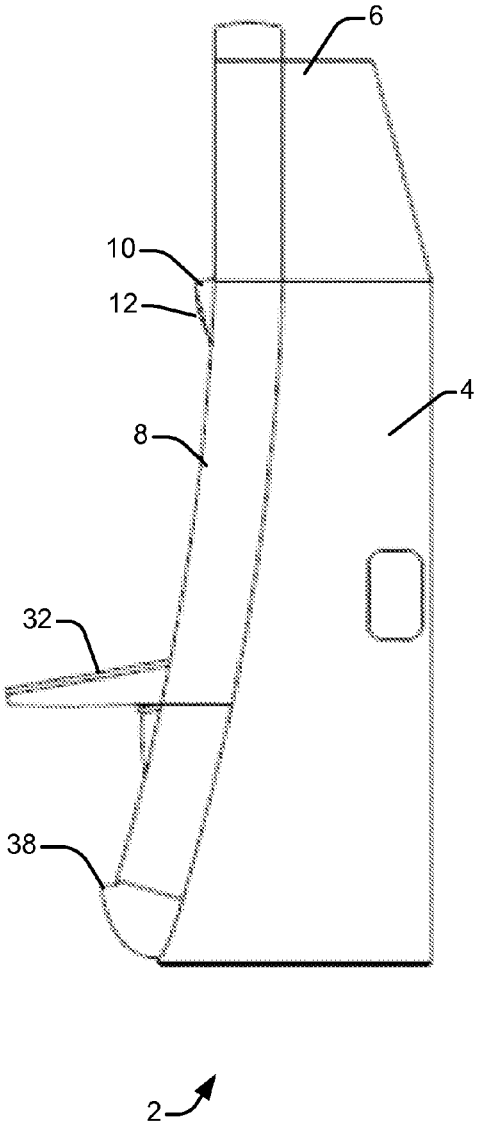

FIGS. 1A, 1B, and 1C show isometric, front, and side views, respectively, of a gaming machine 2, configured in accordance with one implementation. As illustrated in FIGS. 1A-1C, gaming machine 2 includes a main cabinet 4, which generally surrounds the machine interior and is viewable by users. The main cabinet includes a main door 8 on the front of the machine, which opens to provide access to the interior of the machine.

In some implementations, the electronic gaming machine may include any of a plurality of devices. For example, the electronic gaming machine may include a ticket printer that prints bar-coded tickets, a key pad for entering player tracking information, a display (e.g., a video display screen) for displaying player tracking information, card reader 40 for entering a magnetic striped card containing player tracking information, and any other devices needed to provide an entertaining and engaging experience to game players and reliable and secure operation within a gaming establishment environment. The ticket printer may be used to print tickets for a cashless ticketing system. In FIGS. 1A-1C, attached to the main door is a payment acceptor 28, a bill validator 30, and a coin tray 38. The payment acceptor may include a coin slot and/or a payment, note, or bill acceptor, where the player inserts money, coins, tokens, or other types of payments.

In some implementations, devices such as readers or validators for credit cards, debit cards, smart cards, or credit slips may facilitate payment. For example, a player may insert an identification card into a card reader of the gaming machine. The identification card may be a smart card coded with a player's identification, credit totals (or related data) and other relevant information. As another example, a player may carry a portable device, such as a cell phone, a radio frequency identification tag or any other suitable wireless device. The portable device may communicates a player's identification, credit totals (or related data), and/or any other relevant information to the gaming machine. As yet another example, money may be transferred to a gaming machine through electronic funds transfer. When a player funds the gaming machine, a another logic device coupled to the gaming machine may determine the amount of funds entered and display the corresponding amount on a display device.

In some implementations, attached to the main door are a plurality of player-input switches or buttons 32. The input switches can include any suitable devices which enables the player to produce an input signal which is received by the processor. The input switches may include a game activation device that may be used by the player to start any primary game or sequence of events in the gaming machine. The game activation device can be any suitable play activator such as a "bet one" button, a "max bet" button, or a "repeat the bet" button. In some instances, upon appropriate funding, the gaming machine may begin the game play automatically. Alternately, the gaming machine may automatically activate game play after detecting user input via the game activation device.

In some implementations, one input switch is a cash-out button. The player may push the cash-out button and cash out to receive a cash payment or other suitable form of payment corresponding to the number of remaining credits. For example, when the player cashes out, the player may receive the coins or tokens in a coin payout tray. As another example, the player may receive other payout mechanisms such as tickets or credit slips redeemable by a cashier (or other suitable redemption system) or funding to the player's electronically recordable identification card. As yet another example, funds may be transferred from the gaming machine to the player's smart card.

In some implementations, one input switch is a touch-screen coupled with a touch-screen controller, or some other touch-sensitive display overlay to enable for player interaction with the images on the display. The touch-screen and the touch-screen controller may be connected to a video controller. A player may make decisions and input signals into the gaming machine by touching the touch-screen at the appropriate places. One such input switch is a touch-screen button panel.

In some implementations, the gaming machine may include communication ports for enabling communication of the gaming machine processor with external peripherals, such as external video sources, expansion buses, game or other displays, a SCSI port, a key pad, or a network interface for communicating via a network.

In some implementations, the gaming machine may include a label area, such as the label area 36. The label area may be used to display any information or insignia related to activities conducted at the gaming machine.

In some implementations, the electronic gaming machine may include one or more display devices. For example, the electronic gaming machine 2 includes display devices 34 and 45. The display devices 34 and 45 may each include any of a cathode ray tube, an LCD, a light emitting diode (LED) based display, an organic light emitting diode (OLED) based display, a polymer light emitting diode (PLED) based display, an SED based-display, an E-ink display, a plasma display, a television display, a display including a projected and/or reflected image, or any other suitable electronic display device.

In some implementations, the display devices at the gaming machine may include one or more electromechanical devices such as one or more rotatable wheels, reels, or dice. The display device may include an electromechanical device adjacent to a video display, such as a video display positioned in front of a mechanical reel. The display devices may include dual-layered or multi-layered electromechanical and/or video displays that cooperate to generate one or more images. The display devices may include a mobile display device, such as a smart phone or tablet computer, that allows play of at least a portion of the primary or secondary game at a location remote from the gaming machine. The display devices may be of any suitable size and configuration, such as a square, a rectangle or an elongated rectangle.

In some implementations, the display devices of the gaming machine are configured to display game images or other suitable images. The images may include symbols, game indicia, people, characters, places, things, faces of cards, dice, and any other images. The images may include a visual representation or exhibition of the movement of objects such as mechanical, virtual, or video reels and wheel. The images may include a visual representation or exhibition of dynamic lighting, video images, or any other images.

In some implementations, the electronic gaming machine may include a top box. For example, the gaming machine 2 includes a top box 6, which sits on top of the main cabinet 4. The top box 6 may house any of a number of devices, which may be used to add features to a game being played on the gaming machine 2. These devices may include speakers 10 and 12, display device 45, and any other devices. Further, the top box 6 may house different or additional devices not illustrated in FIGS. 1-2B. For example, the top box may include a bonus wheel or a back-lit silk screened panel which may be used to add bonus features to the game being played on the gaming machine. As another example, the top box may include a display for a progressive jackpot offered on the gaming machine. As yet another example, the top box may include a smart card interaction device. During a game, these devices are controlled and powered, at least in part, by circuitry (e.g. a master gaming controller) housed within the main cabinet 4 of the machine 2.

In some implementations, speakers may be mounted and situated in the cabinet with an angled orientation toward the player. For instance, the speakers 10 and 12 located in top box area 6 of the upper region of gaming machine 2 may be mounted and situated in the cabinet with an angled orientation down towards the player and the floor. In one example, the angle is 45 degrees with respect to the vertical, longitudinal axis of machine 2. In another example, the angle is in a range of 30-60 degrees. In another example, the angle is any angle between 0 and 90 degrees. In some implementations, the angle of speakers in the gaming machine may be adjustable. For instance, speakers may be adjusted to face in a direction more closely approximating an estimated position of a player's head or facial features.

The bill validator 30, player-input switches 32, display screen 34, and other gaming devices may be used to present a game on the game machine 2. The devices may be controlled by code executed by a master gaming controller housed inside the main cabinet 4 of the machine 2. The master gaming controller may include one or more processors including general purpose and specialized processors, such as graphics cards, and one or more memory devices including volatile and non-volatile memory. The master gaming controller may periodically configure and/or authenticate the code executed on the gaming machine.

In some implementations, the gaming machine may include a sound generating device coupled to one or more sounds cards. The sound generating device may include one or more speakers or other sound generating hardware and/or software for generating sounds, such as playing music for the primary and/or secondary game or for other modes of the gaming machine, such as an attract mode. The gaming machine may provide dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized for or to provide any appropriate information.

In some implementations, the gaming machine may include a sensor, such as a camera that is selectively positioned to acquire an image of a player actively using the gaming machine and/or the surrounding area of the gaming machine. The sensor may be configured to capture biometric data about a player in proximity to the gaming machine. The biometric data may be used to implement mechanical and/or digital adjustments to the gaming machine. Alternately, or additionally, the sensor may be configured to selectively acquire still or moving (e.g., video) images. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol, animated avatar, or game indicia. In some implementations, the sensor may be used to trigger an attract mode effect. For example, when the sensor detects the presence of a nearby player, the gaming machine may play sound effects or display images, text, graphics, lighting effects, or animations to attract the player to play a game at the gaming machine.

Gaming machine 2 is but one example from a wide range of gaming machine designs on which the techniques described herein may be implemented. For example, not all suitable gaming machines have top boxes or player tracking features. Further, some gaming machines have only a single game display—mechanical or video, while others may have multiple displays.

All of the following methods and processes, along with other methods and processes of the present invention, may be implemented by software, firmware and/or hardware. For example, the methods of the present invention may be implemented by computer programs embodied in machine-readable media. The machine-readable media may be non-transitory, such as non-volatile memory, volatile memory, hard disks, CD-ROM, DVD-ROM, etc. The machine readable media may also be, in some implementations, transitory, such as carrier waves carried over a wire or via radio waves. The invention may be implemented by networked gaming machines, game servers and/or other such devices. Those of skill in the art will appreciate that the steps of the methods described herein are not necessarily performed (and in some implementations are not performed) in the order shown. Moreover, some implementations of the methods described herein may include more or fewer steps than those shown and/or described.

Figure 2:
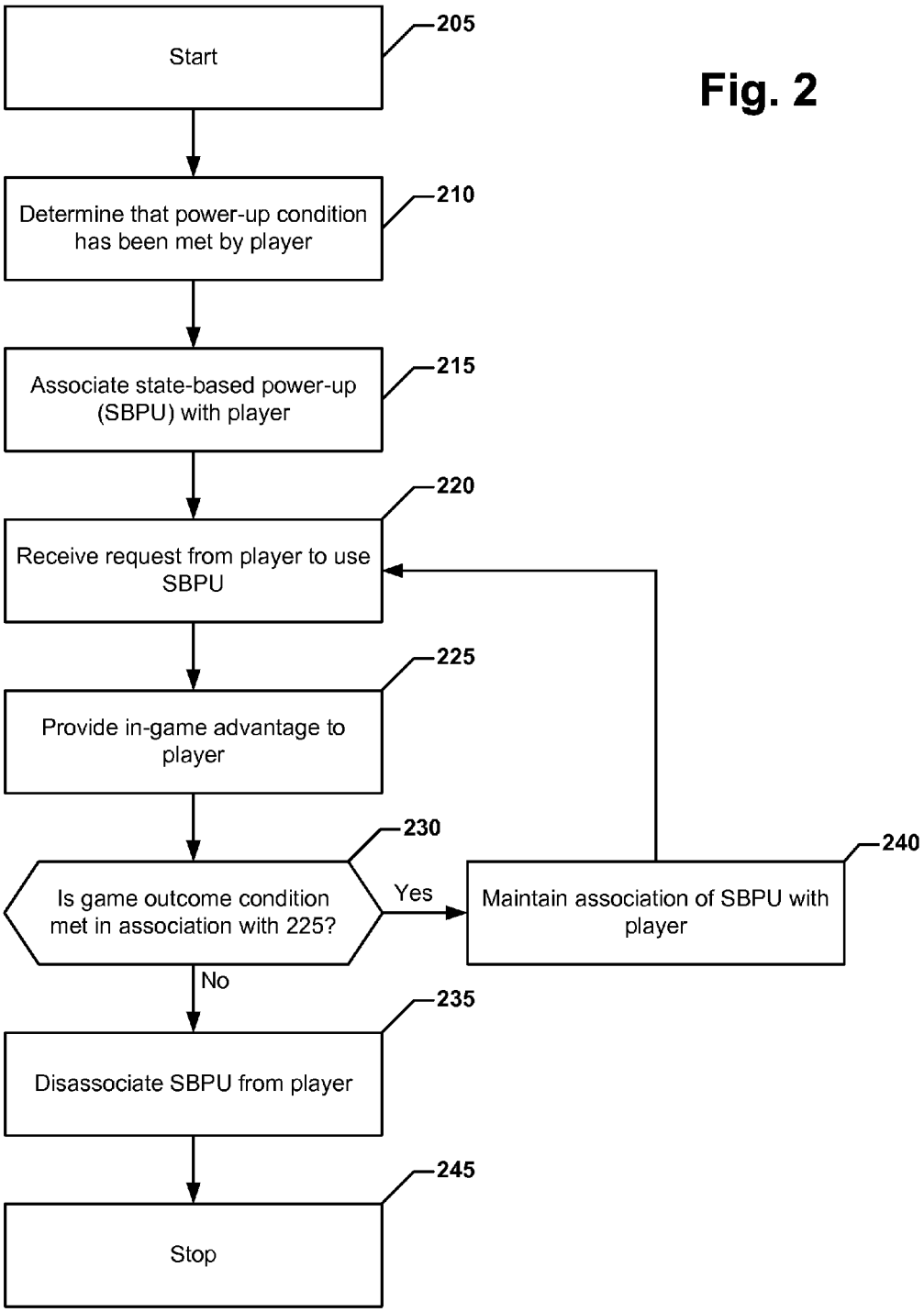
FIG. 2 depicts a high-level diagram of one technique for providing state-based power-ups.

In some implementations, a state-based power-up (SBPU) may be provided as shown in the high-level diagram of FIG. 2, which begins with step 205. For example, a player may, at a high level, be awarded an SBPU in response to the player meeting a power-up condition (210). The player may be alerted to the award of the SBPU by a graphic or other communication from a gaming machine. The SBPU may be associated with the player (215), allowing the player to redeem the SBPU for an in-game advantage. The player may request that the associated SBPU be used to provide an in-game advantage during a wagering game (220). The in-game advantage may be provided (225), and a determination made as to whether a game outcome condition has been met in association with providing the in-game advantage (230). If the game outcome condition is met in association with providing the in-game advantage, the association of the player with the SBPU may be maintained (240), allowing the player to request that the SBPU be used to provide an in-game advantage again. If the game outcome condition is not met in association with providing the in-game advantage, the SBPU may be disassociated from the player (235) and the player may not be allowed to request that the SBPU be used to provide the in-game advantage again, at least until the player has re-earned the SBPU by satisfying the power-up condition again. The technique ends in step 245. Because the association of the SBPU with the player is dependent on the game outcome condition, the power-up may be thought of as "state-based."

Figure 3:
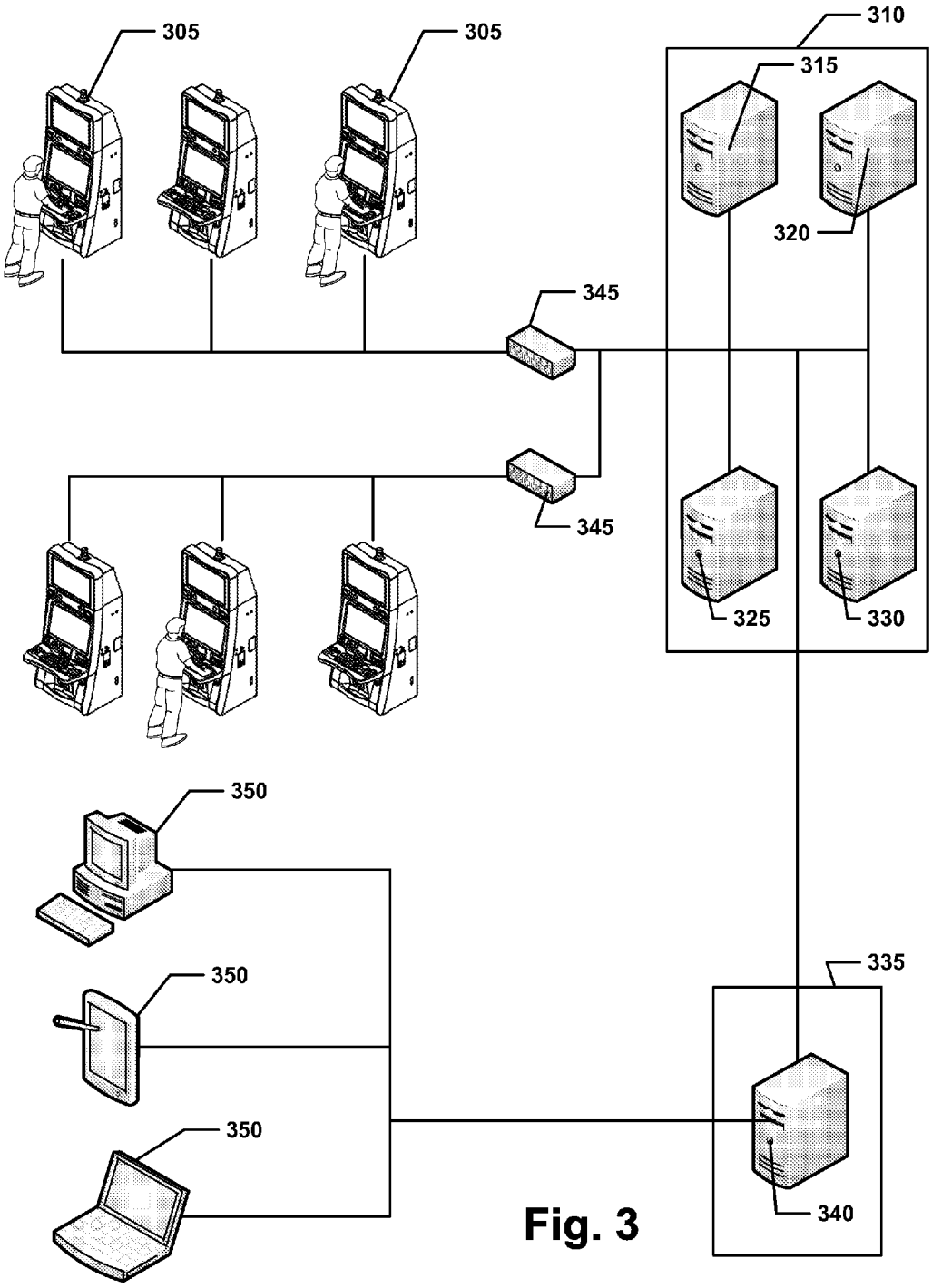
FIG. 3 depicts a high-level system diagram of one implementation of a system which may be used to implement a state-based power-up technique.

A high-level diagram of an example implementation of an SBPU management system, which may, for example, be used to implement the technique outlined in FIG. 2, is shown in FIG. 3. At various points, parenthetical references to the technique of FIG. 2 may be made in association with components shown in FIG. 3 which may be used to implement various aspects of the technique of FIG. 2, although such references are not to be viewed as limiting the implementation of the various aspects of the technique of FIG. 2 to the specific structures so identified. It is also to be understood that the functionality of the components shown and discussed may be implemented using a variety of different structures other than those shown in FIG. 3. In some implementations, some of the functionality which is shown as being performed by different components in FIG. 3 may be performed by a single component. Similarly, in some implementations, some of the functionality which is depicted as being performed by a single component in FIG. 3 may be performed by separate components instead. In some implementations, not all of the components or functionality will be present, depending on the functionality desired. It is to be understood that this application is intended to cover any combination of hardware and software which may be used to practice the concepts outlined herein, and is not to be limited to only the specific implementations shown.

FIG. 3 depicts gaming machines 305 communicatively connected with bank controllers 345, which are, in turn, communicatively connected with equipment in remote site 310. Remote site 310, which may be located at a site other than the casino in which gaming machines 305 are located or may simply be located in a location other than where gaming machines 305 are located but with the same casino as gaming machines 305, may include a variety of different servers or other equipment which is configured to communicate with and manage various aspects of gaming machines 305. For example, remote site 310 may include player tracking server 315, power-up management server 320, play management server 325, and external communications server 330, which may be configured to communicate with each other. Gaming machines 305 may include interfaces by which players may input information and requests, such as request to redeem an SBPU (220). Gaming machines 305 may also, in some implementations, be configured to provide in-game advantages in response to requests to redeem an SBPU.

It is to be understood, as indicated previously, that servers 315, 320, 325, and 330 may be configured differently than as shown. For example, the functionality of power-up management server 320 may be incorporated into player tracking server 315, and no separate power-up management server 320 may be required.

Player tracking server 315 may be configured to manage various aspects of player tracking. For example, player tracking server 315 may communicate with a gaming machine 305 to receive information identifying a player utilizing that gaming machine 305, such as information received from a player tracking card inserted into a card reader on gaming machine 305. Player tracking server 315 may utilize such information to retrieve records from a player tracking database connected to player tracking server 315 which provide player tracking information regarding the player.

Power-up management server 320 may be configured to track SBPUs and their associations with players. Power-up management server 320 may include, for example, an SBPU database which includes records linking SBPUs with individual players, or with individual gaming machines. Such records may also include information which indicates whether the SBPU of the linked record is associated with the player or the gaming machine. As explained more fully below, an SBPU which is linked to a gaming machine may be indirectly associated with a player playing the gaming machine. Power-up management server 320 may also be configured to disassociate players from SBPUs which it tracks.

In addition to tracking the association/disassociation of SBPUs with players directly or indirectly via gaming machines, power-up management server 320 may also manage information regarding what the in-game advantage(s) of each SBPU is. Such information may be communicated to gaming machines 305 to allow gaming machines 305 to provide the in-game advantage during game play. In some implementations, the game play and in-game advantage may be provided by a server-based system, in which case the information may not be communicated to the gaming machine, but to the server providing for game play.

Power-up management server 320 may also store information regarding the power-up conditions and game outcome conditions associated with various SBPUs. Such condition information may be transmitted to, for example, gaming machines 305 or play management server 325, and used by such components to monitor for the occurrence of such conditions.

Play management server 325 may be configured to monitor various aspects of game play on gaming machines 305. In some implementations, gaming machines 305 may be configured to self-monitor, which may reduce or eliminate the need for play management server 325. Play management server 325 may, for example, monitor game play on gaming machines 305 for the satisfaction of game outcome conditions (230) on gaming machines 305. Upon detection of the satisfaction of such game outcome conditions (230), play management server 325 may notify power-up management server 320 of the respective gaming machine or player associated with the satisfaction of the game outcome conditions. Play management server 325 may similarly be configured to monitor game play on gaming machines 305 for the satisfaction of power-up conditions (210), and communicate such information to power-up management server 320 as well. Power-up management server 320 may, in response to information received from play management server 325, associate (215), maintain an association of (240), or disassociate (235) SBPUs as appropriate from players or from gaming machines.

External communications server 330 may be configured to receive information indicating the association or disassociation of an SBPU with a particular player and communicate such information to players, or gaming machines used by players, other than the player associated with/disassociated from the SBPU. External communications server 330 may also be configured to communicate such information to external entity 335, e.g., a social networking site such as Facebook. External communications server 330 may be configured to transmit such data to social networking server 340 at external entity 335, which may then be used to relay such information to individual personal computing devices 350 via, for example, the Internet.

In some implementations, all or some of the functionality described above may be implemented at the gaming machine. For example, the master gaming controller or other similar equipment for a gaming machine 305 may monitor game play at the gaming machine and associate/disassociate SBPUs with the player of the gaming machine in accordance with various power-up conditions/game outcome conditions.

Various further details and examples of SBPU techniques are presented below. These techniques may be implemented using the systems and equipment described above with respect to FIG. 3, or may be implemented using other systems and equipment providing similar functionality.

An SBPU may be associated with a player in response to triggering a power-up condition. In many implementations, an SBPU may be awarded to a player in response to a power-up condition such as the player achieving a particular milestone in the context of wagering game play. For example, an SBPU may be associated with a player in response to the player achieving a particular in-game outcome, such as, but not limited to, a particular pattern of symbols in a slot machine payline, a particular pattern of symbols for a scatter trigger on a slot machine, a particular pattern of sub-symbols in a slot machine, a particular hand in a poker game, a particular card combination in a blackjack or baccarat game, or a particular bingo pattern. In some implementations, an SBPU may be associated with a player in response to a random determination being met during a play of the game that is unrelated to the displayed game outcome itself. In some implementations, an SBPU may be associated with a player in response to a condition being met which is unrelated to any particular game. For example, a player may receive an SBPU in exchange for opening a player tracking account, booking a room at a casino resort, or as a gift from a casino operator or friend on their birthday. In some implementations, the power-up condition may include the player achieving a predetermined metric indicative of a quantity of game play, such as inputting a certain amount of coin-in, playing a predetermined number of games, or engaging in wagering play for a predetermined period of time. In some implementations, the amount of coin-in during a given period across a group of gaming machines may be tracked and a coin selected from a range of coins, e.g., a random coin may be chosen from the range of the $100^{th}$ to the $200^{th}$ coin-in as the power-up condition. The player responsible for contributing that coin may be rewarded with an SBPU. While the term "coin-in" is used in this application, it is to be understood that credits or cash may be used just as well.

In some implementations, the game outcome condition may involve the player achieving a predetermined sequence of game outcomes. For example, an SBPU may be associated with a player if the player loses five games in a row. A player experiencing five consecutive losses may feel discouraged and be inclined to stop playing; awarding an SBPU to the player may rekindle their interest and keep them playing. In another implementation, an SBPU may be associated with a player if the player achieves back-to-back bonuses during wagering game play. In another implementation, an SBPU may be associated with a player if the player redeems another SBPU a predetermined number of times and satisfies the game outcome conditions for each such redemption. In another implementation, an SBPU may be associated with a player if the player earns a certain level of points based on specific outcomes, events and/or play, the points being different from game credits with which the player wagers.

Association of an SBPU with a player may be effected through a variety of different techniques. In general, an SBPU which is "associated" with a player is an SBPU which the player has the right to redeem for an in-game advantage when all other prerequisites for redemption are met. In some implementations, association of an SBPU with a player may occur by creating a record linking the player to the SBPU in a power-up database or a player tracking system. In this manner, the association of the player with the SBPU may persist from game to game and even, in some cases, from casino to casino. In some implementations, an SBPU may be associated with a player indirectly. For example, an SBPU may be associated with the particular gaming machine that a player is using. In such implementations, since the player is controlling the gaming machine, they would have the right to request that the SBPU associated with the gaming machine be redeemed for an in-game advantage, and the SBPU may also be viewed as being associated with the player. In some other implementations, the SBPU may be associated with an instrument, such as a ticket, token, or voucher, which may be scanned or otherwise evaluated by, for example, a gaming machine. The instrument may be generated by a gaming machine, kiosk, or other gaming device via, for example, a printer. After evaluating the instrument, the SBPU associated with the instrument may be made available to the holder of the instrument, e.g., the player. In this manner, the SBPU is associated with the player indirectly through the player's possession of the instrument which is associated with the SBPU. Because the instrument may persist after the player has left a particular gaming machine, the instrument may allow the player to transport an SBPU from gaming machine to gaming machine.

An SBPU may be linked to a player without necessarily being "associated" as used in the context of this paper. For example, a database record may indicate that a particular SBPU is linked to a particular player, but the record may not indicate that that particular player has the right to redeem the SBPU for the in-game advantage.

An associated SBPU may be indicated to a player through a number of techniques. In some implementations, a gaming machine used by the player may display icons associated with various associated SBPUs. The icons may also include numbers indicating how many of each type of SBPU are currently associated with the player. Text or sound may also be used to convey such information to the player.

An SBPU may be redeemed by a player during wagering game player for an in-game advantage. In some implementations, an SBPU may be redeemed only during certain predefined periods of time, such as before or after certain stages of game play. In some implementations, a player may only be given a limited timeframe in which an SBPU may be redeemed within a given game. For example, if a player is associated with an SBPU which allows the player to replace a single card in their initial hand in a multiplayer Texas Hold'em poker game, the player may only be given 10 seconds after receiving the initial hand in which to decide whether or not to use the SBPU to obtain the replacement card.

Some SBPUs may only be redeemable by a player when particular game conditions are met. For example, a particular SBPU for use in a blackjack game may allow a player to draw an additional card after doubling-down, where the player is normally only allowed a single drawn card to the doubled-down hand. In such a case, the SBPU would not be redeemable by the player if their hand is not eligible for double down or if the hand is eligible but the player elects not to double down. The player would still be considered to be "associated" with the SBPU because, once the in-game conditions are met, the player has the right to redeem the SBPU.

The actual redemption of an SBPU may be initiated by the player using an interface such as, for example, a gaming machine touchscreen. For example, a player may wish to redeem a "Double Points" SBPU and, to do so, may simply tap an icon representing the "Double Points" SBPU during game play. In other implementations, the player may select which SBPU to redeem using various buttons on the gaming machine, or via other input techniques.

The in-game advantage provided for an SBPU may be tailored to a particular game or may be applicable to a variety of different games. For example, an SBPU which allows a player to "re-spin" a reel on a slot machine may only be redeemable in a particular slot machine game, or only in slot machine games in general. If a player with the "re-spin" SBPU were to play a poker game, such an SBPU would be unusable while the player played the poker game.

In other implementations, an SBPU may be generally applicable to multiple types of wagering games. For example, an SBPU may allow the associated player to play a fair double-or-nothing proposition, such as predicting the parity (even or odd) of a fair die, or the color of the next dealt card, with their winnings in a variety of games. Such an SBPU could be used in a variety of different wagering games, such as slots, poker, blackjack, bingo, keno, etc.

In some implementations, an SBPU may be portable between different kinds of game and the in-game advantage it provides may vary depending which game is being played when the SBPU is redeemed. For example, an SBPU may be redeemable for a re-spin in a slot machine game but also be redeemable for a re-draw of a card in a poker or blackjack game. The appropriate in-game advantage may be selected based on which game is being played when redemption of the SBPU is requested.

In some implementations, the in-game advantage of an SBPU may change during wagering game play. In one example, the SBPU may allow a player in a Texas Hold'em poker game to discard and redraw up to two cards from the player's initial poker hand prior to the flop being dealt, but may only allow the player to discard and redraw one card from the player's hand after the flop is dealt.

In some implementations, a player may be provided with benefits other than, or in addition to, an in-game advantage, such as voting points for use in a player poll such as is described in U.S. patent application Ser. No. 13/250,813, by Davis et al., entitled "WAGER GAMING VOTING LEADERBOARD," filed concurrently herewith, the entirety of which is incorporated herein by reference for all purposes.

The association of a player with an SBPU may be maintained based on whether a game outcome condition associated with the use of the SBPU is met. For example, if a player redeems an SBPU which allows the player to re-spin a slot machine reel, the game outcome condition may require that the player match or increase their score or payout as a result of the re-spin. If the player redeems the SBPU, re-spins the reel, and attains a lower result than they had before redeeming the SBPU, the game outcome condition would not be met and the SBPU would be disassociated from the player, i.e., the player would no longer have the right to redeem the SBPU. However, if the player redeems the SBPU, re-spins the reel, and attains a similar or better outcome due to the re-spin, the player's association with the SBPU is maintained, i.e., the player retains the right to redeem the SBPU for at least one more redemption.

A variety of game outcome conditions may be used in various implementations. In some implementations, a player may simply need to better their score or payout as a result of redeeming the SBPU. In some implementations, the player may need to achieve a certain ranking with respect to a metric of game play with respect to other players. For example, a player may be associated with an SBPU which may be redeemed in a poker game to allow the player to swap a card from their hand with a random card from the hand of another player in the poker game. The game outcome condition for such an SBPU may be that the player attain a better poker hand than the player with whom he swapped the card. The player may not, however, be required to be the absolute winner of the poker round. In some implementations, the use of the SBPU may actually not materially affect the outcome of the game play associated with the use of the SBPU, but the game outcome condition may be met nonetheless because the condition would be true regardless of whether or not the SBPU was used. In some implementations, however, the game outcome condition must be met as a result of using the SBPU as part of the condition.

In some implementations, the player may need to achieve a certain ranking with respect to a metric of game play with respect to other players who are playing synchronously with the player. For example, the player may be playing a game of poker with a group of other players. All of these players experience substantially the same start and end to each round of poker since, and may be said to be playing synchronously. Due to the synchronous nature of the game play, the metric of game play may be evaluated with respect to each unit of play, e.g., each round of poker, each blackjack game, etc. In some other implementations, the player may need to achieve a certain ranking with respect to a metric of game play with respect to other players who are playing asynchronously with the player. For example, the player may be one of several players playing slot machines in a bank of slot machines. Each slot machine, however, may be a stand-along game and each player may play at their own pace regardless of the pace of the other players' play. In such implementations, the metric of game play may be evaluated over time or over a number of play units, such as over an hour or over ten slot machine spins.

If the game outcome condition is not met in association with providing the in-game advantage, the SBPU may be disassociated from the player and the player may not be allowed to request that the SBPU be used to provide the in-game advantage again, at least, until the player is associated or re-associated with the SBPU due to satisfying a power-up condition at a later time. A player may re-earn the right to redeem an SBPU which was previously disassociated if the appropriate power-up condition is met again.

Disassociation of an SBPU from a player may occur through a variety of mechanisms. For example, in some implementations, a database record linking the SBPU to the player may be updated with a flag indicating that the player no longer has the right to redeem the SBPU. In other implementations, the database record may simply be deleted such that there is no record linking the player to the SBPU at all, and the SBPU may be assumed, in the absence of such a linking record, to be disassociated from the player. In implementations where an SBPU is associated with a particular gaming machine, the gaming machine may be configured to flag the SBPU as inactive, which would disassociate the SBPU from the player using the gaming machine.

Various implementations of SBPUs are discussed below in the context of various types of wagering games. The names provided for the SBPUs are generic, descriptive names—SBPU's may, in practice have more colorful names associated with a game theme.

Slot Machine-Specific SBPUs.

| SBPU | In-Game Advantage |
|---|---|
| Re-spin | Allows player to re-spin a reel. In some implementations, the player may select the reel to re-spin, and in other implementations, the reel is selected randomly. |
| Nudge | Allows player to advance a reel by a controlled amount, e.g., 1 stop, 2 stops, or three stops. In some implementations, the player may select the number of stops to advance a reel, but the reel which is advanced may be randomly selected. In some implementations, the player may select the reel to advance, but the number of stops advanced may be random. |
| Wild | Allows player to make a randomly selected symbol "wild," i.e., one symbol position or one type of symbol will become wild and the game outcome will be re-evaluated. |
| Forced Tumble | Allows player to cause a randomly selected symbol to tumble as described in U.S. patent application Ser. No. 12/853,050 by Decasa et al. entitled "GAMING SYSTEM, GAMING DEVICES AND METHOD FOR PROVIDING A CASCADING SYMBOL GAME INCLUDING SHIFTING DIFFERENT DETERMINED SYMBOLS," the entirety of which is incorporated herein by reference for all purposes. |
| Symbol Shuffle | Allows players to cause symbols to randomly rearrange (such as done in the game Frantic Antics). |
| Reel Shuffle | Allows players to cause reels to randomly rotate or otherwise rearrange. |
| Paylines | Allows players to cause one or more additional paylines to randomly appear. |
| Symbol Replace | Allows player to cause symbol in one or more player-selected positions to be randomly replaced by another symbol. |
| Sticky Symbol | Allows player to cause symbols in one or more player-selected positions to remain in place or "stick" for the next slot pull and game outcome. |
| Wild Reposition | Allows player to cause one or more visible wild symbols to randomly reposition. |

Poker-Specific SBPUs.

| SBPU | In-Game Advantage |
|---|---|
| Extra card | Allows player to draw an extra card. In some implementations, the player may draw the extra card at any time during a poker round. In other implementations, the player may have limited opportunities to do so, such as only after the initial hand is dealt, or only after all cards have been dealt. |
| Card swap | Allows player to swap a card from their hand with a card from another player's hand. Various implementations of this SBPU may include, for example, allowing the player to blindly select which card is to be swapped from the other player's hand or selecting the swapped card from the other player's hand randomly. |
| Card swap II | Allows player to swap a card from their hand with a face-up community card. In some implementations, the player may select the in-hand card and the card with which it is to be swapped. In other implementations, the player may choose the in-hand card, but the face-up card is selected randomly. In yet other implementations, the player may choose the face-up card, but the in-hand card is selected randomly. |
| Draw preview | Allows player to preview, for example, the next card which will be drawn. In draw poker, a player may use this SBPU to see if it is more advantageous to discard a card and request a new draw, or if the present hand should be kept as-is. |
| Modify draw | Allows player to modify the draw order of cards prior to being dealt. In some implementations, the player may peek at some predetermined number of upcoming draw cards. In some further implementations, the |

-continued

| SBPU | In-Game Advantage |
|---|---|
| | player may reorder the draw order of the peeked cards, or even discard one or more of them. |
| Suited | Allows player to collect extra winnings if one or more cards in their winning hand is of a particular suit. In some implementations, the highest-valued card in the hand must be of the particular suit to collect the extra winnings. |

Blackjack-Specific SBPUs.

| | |
|---|---|
| Unhit | Allows player to take back a "hit," i.e., return the most recent drawn card back to the deck. In some implementations, the most recent drawn card may simply be discarded from the player's hand. |
| Split | Allows player to split his hand into two hands. In some implementations, the player may do so after going bust, thereby producing two non-bust hands for further play. |
| Card swap | Similar to the "card swap" of poker-specific SBPUs, although player may swap cards with the dealer in addition to the other players. |
| Reducer | Allows player to subtract up to X from their hand's score. For example, may allow the player to subtract up to 3 points from their score, which may allow the player to turn a bust into a blackjack in some circumstances. |
| Double Down Plus | Allows player to get an additional card after a Double Down. |
| Split Ace Grace | Allows player to overcome standard rule that only one card can be drawn to split aces which can include some or all of the following: ability to resplit (irrespective of split limits), ability to hit, and ability to double down. |
| Power Double | Allows the player to burn an initial double down card and receive a replacement card (as featured in the blackjack game variation "Power Blackjack"). |
| Extra Deep Deal | Allows player an additional deal after end-of-shoe separator reached. |
| Peek | Allows player to see value of next card on deck, i.e., next card to be drawn, before making his/her next play decision (e.g. hit, stand, double down, split) |

Bingo-Specific SBPUs.

| | |
|---|---|
| Swap | Allows player to swap numbers in two squares on the bingo card. In some implementations, this may include any two squares on the bingo card. In other implementations, it may include any two squares in the same column. Some implementations may only allow swapping squares if neither square is daubed. |
| Extra ball | Allows players to draw an extra ball which would ordinarily not be drawn. In some implementations, the extra ball only applies to that player's bingo card. |
| Shuffle | Allows players to shuffle the numbers on their bingo card. |

Keno-Specific SBPUs.

| | |
|---|---|
| Extra Draw | Allows player to obtain one or more additional ball draws. |
| Bonus Spot | Allows player to randomly reassign bonus numbers that were not already hit, possibly leading to some other hit number being re-assigned as a bonus spot. |

Roulette-Specific SBPUs.

| | |
|---|---|
| Replace number | Allows player to "re-spin" a digit in the roulette outcome. For example, if the player bet on 17 and 7 came up, the player may use this SBPU to "re-spin" the tens digit (which would result in 7, 17, or 27). In some implementations, the numbers 37 and 38 may correspond to the roulette numbers "0" and "00." |

Various game outcome conditions may be used to determine if an association between a player and an SBPU should be maintained. For example, some implementations may have a game outcome condition where a player is required to win the current wagering event. In some implementations, the player may simply be required to win more than their wager, i.e., do better than break even. In some other implementations, the player may be required to at least win double their wager.

In some implementations, the game outcome condition for one player and the power-up condition for another player may be linked. For example, a multiplayer poker game may include the SBPU, discussed previously, which allows a player to swap a card from their hand with a random card from another player's hand. The game outcome condition might be that the player with the SBPU have a better hand than the other player's hand after using the SBPU on the other player in a given round. At the same time, the power-up condition for the other player may be that the other player have a better hand than the player despite the player's use of the SBPU. If the player uses the SBPU against the other player and has an inferior hand, not only does the player lose the hand against the other player and lose the SBPU, but the other player then gains the SBPU. In this way, the game outcome condition for the player and the power-up condition for the other player are linked—the association of the SBPU with the other player requires disassociation of the SBPU with the player. In some implementations, there may be only one SBPU in a given game, although in other implementations, there may be more than one SBPU.

In some implementations, an SBPU may be disassociated from a player regardless of whether the player has redeemed the SBPU and satisfied a game outcome condition, such as after a predetermined period of time has elapsed. For example, an SBPU may be associated with a player for a limited period of time and may be disassociated from the player at the end of that time period regardless of whether or not the SBPU is redeemed and regardless of whether the player has satisfied the game outcome condition associated with the SBPU. In a different implementation, an SBPU may be associated with a player for a limited period of time and may be disassociated from the player at the end of that time period unless the player has redeemed the SBPU for the in-game advantage and satisfied the game outcome condition during the time period. In such implementations, the satisfaction of the game outcome condition may reset the time period, and the player will have to redeem the SBPU again and satisfy the game outcome condition again within the reset time period to maintain an association with the SBPU. The predetermined time period may be in temporal units, e.g., five minutes, in units of play, e.g., five games, or in other units, e.g., five game wins.

It is to be understood that, in many implementations, the game outcome condition for an SBPU will not be the trivial case of maintaining the association of the SBPU with the player only if the SBPU has been redeemed less than one time, i.e., a guaranteed single-use power-up. It is also to be understood that while the game outcome condition for an SBPU may feature a time limit or multiple-use limit, for many implementations, such time limits or multiple-use limits will always be alternative to, or supplementary to, other conditions which are based on other factors. Other implementations, however, may utilize a game outcome condition which consists only of a limited time-duration for the SBPU or a limited number of uses of the SBPU, regardless of other conditions.

In some implementations, an SBPU may be disassociated from a player based on the actions of another player, regardless of whether the player has redeemed the SBPU and satisfied a game outcome condition. In one example implementation, a poker game may have an SBPU which allows the associated player to swap a card from their hand with a random card from another player's hand. There may be only one such SBPU, or a limited number of SBPUs, in the poker game. The power-up condition may be that a player achieve a card hand of a straight or better. If a player then achieves a card hand of a straight or better, the player is associated with the SBPU and the player who was previously associated with the SBPU is disassociated from the SBPU. In some implementations, there may be alternate power-up conditions. For example, the power-up condition may be that the player have a straight or better in their hand, or that the player have a better hand than another player, associated with the SBPU, who uses the SBPU against the player and loses despite the use of the SBPU.

In general, the power-up condition and the game outcome condition for an SBPU may be selected based on the in-game advantage which the SBPU provides to the associated player. For example, a player may earn a Bonus Trigger Scrambler power-up as a consolation in a five-column, three-row slots game if the player fails to trigger a bonus game for a certain period of time or consecutive plays. The slots game in this example triggers the bonus game if 3 or more bonus symbols occur across a game payline during play of the base game; for the purposes of this example, a maximum of one bonus symbol may be displayed in each of the first three symbol columns, and the fourth and fifth columns do not display bonus symbols. The Bonus Trigger Scrambler power-up in this example may only be used if the bonus game is not triggered despite each of the first three columns including a bonus symbol, i.e., the bonus symbol appears in each of the first three columns but the three bonus symbols are not positioned along a payline. There are 27 possible positions for the 3 bonus symbols across the first three columns and three rows, but only 9 of those positions result in the 3 bonus symbols falling along a payline and triggering the bonus game. Therefore, a player has a 9 in 27 chance that the activation of the Bonus Trigger Scrambler power-up will reposition 3 bonus symbols into one of the 9 configurations that will actually trigger bonus game play. The power-up condition may be selected according to this probability, e.g., the number of consecutive base game plays which fail to trigger the bonus game may be set based at least in part on the subsequent probability of successful Bonus Trigger Scrambler user. If the activation of the Bonus Trigger Scrambler successfully triggers the bonus game play, then the player may keep the Bonus Trigger Scrambler power-up ability for future use whereas if the activation of the Bonus Trigger Scrambler does not trigger the bonus game play, then the player forfeits the Bonus Trigger Scrambler power-up. An alternative SBPU retention condition may involve the player either successfully triggering bonus game play by using the SBPU, or, as a side effect of using the SBPU, achieving a better payline outline due to the scramble.

In some implementations, an SBPU may only be redeemed by a player for the in-game advantage if the current wager is at least as great as a wager which resulted in the SBPU being associated with the player. Such implementations prevent a player from wagering at low amounts to accumulate SBPUs which the player then redeems during higher-stakes wagering play. In some such implementations, the player may still redeem the SBPU for the in-game advantage if the current wager is higher than the wager which resulted in the SBPU being associated with the player.

In some implementations, multiple SBPUs of the same type earned at a lower wagering level may be redeemed for an in-game advantage at a higher wagering level. For example, a player may have earned five "extra card" SBPUs while wagering at the 20¢ level. The player may not be allowed to redeem one of these SBPUs while wagering at the $1 wagering level, but may be allowed to redeem all five SBPUs for one in-game advantage at the $1 wagering level.

In some implementations, an SBPU earned at a lower wagering level, e.g., 20¢, may be redeemed for an in-game advantage at a higher wagering level, e.g., $1, but the in-game advantage may be pro-rated or limited apply to only the amount of the current wager which corresponds to the lower wagering level. For example, the player may redeem an SBPU earned at the 20¢ wagering level which allows the player to triple their payout on a $1 wager. If the player wins the wager and would ordinarily receive $3 in return, an SBPU earned on a $1 wager would result in the current payout tripling to $9, but the SBPU earned on the 20¢ wager would result in the current payout only rising to $4.20.

In some implementations, the power-up condition may require, as part of the condition, that the player have bet the MAX bet level allowed by a wagering game. In some implementations, the power-up condition may require, as part of the power-up condition, that the player have wagered at least sufficient coin over multiple games to equal the MAX bet amount for one game. In some such implementations, the power-up condition may require that the player have wagered amounts totaling to at least the MAX level over the course of game play since the last time the player satisfied a power-up condition. For example, if the MAX bet is $1, the player is playing at a 20¢ wagering level, and the player just earned an SBPU by satisfying the power-up condition, the player may not be eligible to earn another SBPU until at least the fifth turn after earning the previous SBPU. Other implementations may not require such eligibility requirements.

In some implementations, the power-up condition may allow for players to purchase a chance to win the SBPU. For example, a player may desire an SBPU during play but not be associated with the SBPU at that time. The player may, in some implementations, pay a fee which allows the player a chance to play a mini-game in which the prize is the SBPU. For example, for a $1 fee, the player may be presented with three doors on a display device, one of which hides the SBPU. If the player picks the correct door, they are associated with the underlying SBPU. If the player picks the incorrect door, they are not associated with the SBPU. In some such implementations, the fee may be returned to the player if they redeem the SBPU in the game in which it is earned and satisfy the game outcome condition. In some implementations, the player may pay a fee which guarantees the association of the SBPU with the player; such implementations may forego the mini-game and simply associate the SBPU with the player. In some implementations, this latter approach may skip the mini-game aspect entirely and allow the player to purchase an SBPU directly in exchange for the fee. In some such implementations, the SBPU which is provided may randomly selected from a group of available SBPUs. In some further implementations, the player may pay an increased fee for the right to select which SBPU will be received.

In some implementations, a player may redeem an SBPU and fail to satisfy the game outcome condition in association with the redemption, but the association of the SBPU with the player may be maintained nonetheless. In such implementations, a determination may be made that the SBPU is to be disassociated from the player in response to the player's non-satisfaction of the game outcome condition. However, rather than immediately disassociating the SBPU from the player, the SBPU system may instead offer to allow the player to maintain the association with the SBPU in exchange for a fee. If the player pays the fee, the association is maintained despite the non-satisfaction of the game outcome condition. If the player does not pay the fee, the SBPU is disassociated as it normally would.

In some implementations, the SBPU may be tied to a specific stake level in a game. For example, a slot machine game may allow a player to place wagers on a 1¢, 2¢, 5¢, and 10¢ stake. In such implementations, the SBPU may only apply to the stake level or to winnings from the stake level in which it was earned.

In some implementations, the SBPU may not be redeemable at all, but may instead confer the in-game advantage continuously throughout a period of time, i.e., a continuous or passive effect SBPU. Such a technique is outlined at a high level, for example, in FIG. 4. The technique may start (405) by associating an SBPU with a player (415) in response to the player triggering a power-up condition (410). The SBPU may provide an in-game advantage continuously during a given time period (425). At the end of the time period, a determination made as to whether a game outcome condition has been met in association with providing the in-game advantage (430). If the game outcome condition is met in association with providing the in-game advantage, the association of the player with the SBPU is maintained (440), allowing the in-game advantage to be provided for another time period (425). If the game outcome condition is not met in association with providing the in-game advantage, the SBPU is disassociated from the player and the in-game advantage is no longer provided (435). In some implementations, the association of an SBPU may be communicated to other players (420) or the disassociation of an SBPU may be communicated to other players (445). The technique may stop (450) after the SBPU is disassociated (445), although the technique may be repeated as needed for subsequent SBPU associations.

Figure 4:
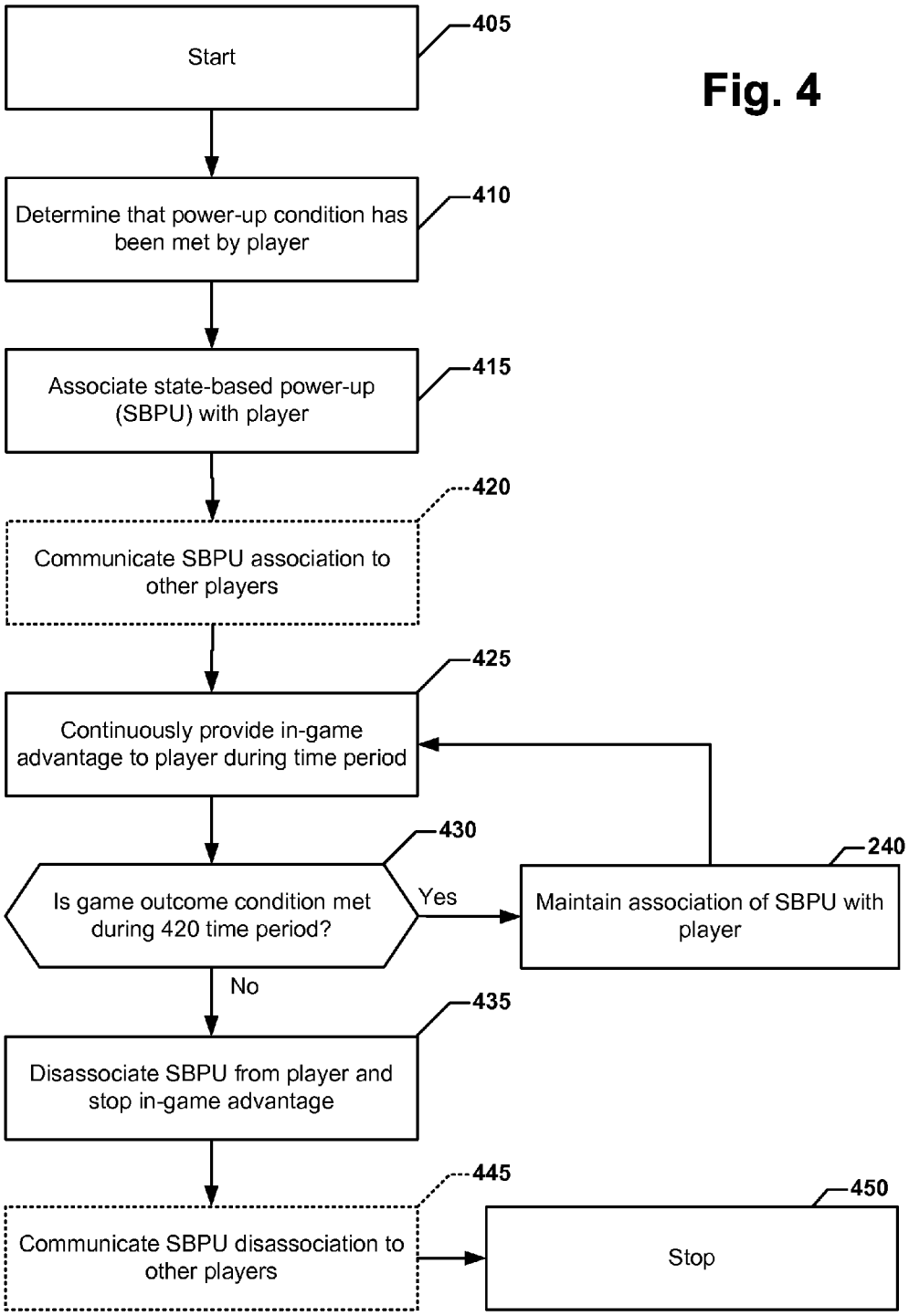
FIG. 4 depicts a high-level diagram of another technique for providing state-based power-ups.

A technique such as that shown in FIG. 4 may be implemented using equipment similar to that shown in FIG. 3, much as the technique of FIG. 2 may be implemented.

In one example implementation, the player may be associated with an "Ace of Hearts" SBPU which doubles the player's payout any time the highest card in the player's hand is a heart. The period of time may be as short as a game play, or may span multiple game plays. The game outcome condition of such an SBPU may be based on the outcome of only one game, e.g., the association of the example "Ace of Hearts" SBPU with the player may be maintained as long as the player has a heart in his hand, or has access to a heart via any community cards, at the end of a round regardless of the value of the heart, or may be based on the outcome of multiple games, e.g., the association of the example "Ace of Hearts" SBPU with the player may be maintained as long as the player has had a heart in his hand for 5 of the last 10 hands.

Continuous-effect SBPUs may be tied to a player's social status. For example, in one example implementation, the player may be associated with the "Ace of Hearts" SBPU. The association of the player with the "Ace of Hearts" SBPU may be communicated to players who are using other gaming machines, for example, via a player tracking system or a power-up management system. The association of the "Ace of Hearts" SBPU may be communicated to other players who are playing against the player in a game, or simply to other players who may have an interest in the player, such as friends, teammates, or former opponents. The association of the player with the "Ace of Hearts" SBPU may then be displayed to the other players via the displays of their respective gaming machines. The player may thus gain potential respect and envy among his or her fellow players regarding his or her association with the "Ace of Hearts" SBPU.

In some implementations, the association of an SBPU with the player may also be communicated to a context outside of normal game play, such as to a social networking website. For example, in the implementation using the "Ace of Hearts" SBPU described above, the association of the "Ace of Hearts" SBPU with the player may be communicated to a Facebook account linked to the player. Such communication may require that the player first enable a custom application on the social networking site which communicates with a SBPU management system. The social networking custom application may, when active on a webpage, query the SBPU management system periodically for updates to the player's status. Such a custom application may also be constructed to allow a player to monitor the associations of SBPUs with other players. In this way, the association of an SBPU with a player becomes an event of social significance, and may promote feelings of community for the player.

The disassociation of continuous-effect SBPUs from a player may also be communicated to other players in much the same manner as the association of continuous-effect SBPUs may be. The disassociation may also be communicated to social networking sites in a manner similar to how the association of SBPUs with the player is communicated. In this manner, the loss of a player's association with an SBPU may cause a sense of community loss among players within the player's social networking circles.

While the social networking aspects discussed above are described with respect to continuous-effect SBPUs, similar techniques may be used for redeemable SBPUs as well. Other data may be reported to, and displayed by, social networking sites as well, such as statistics on which SBPUs the player has won in total, how many SBPUs the player has lost in total, the player's success rate in retaining SBPUs, and so on.

SBPUs, in general, may be managed in a variety of different ways. In some implementations, an SBPU may be offered by a gaming machine during play of a wagering game. The gaming machine, for example, may associate the SBPU with the player, receive requests to redeem the SBPU, evaluate game outcome conditions in association with such redemptions, determine whether or not to disassociate the SBPU from the player, and maintain the association or disassociate the SBPU from the player. The gaming machine may perform all of these functions locally, without any involvement from an outside server.

In other implementations, a server, such as an SBPU manager or management server, may be used. In practice, the SBPU manager or management server may actually comprise several separate machines which provide SBPU management functionality. Such a server may interact with gaming machines and receive information from the gaming machines regarding gaming events. In some embodiments, the gaming machines may make determinations as to whether or not to associate an SBPU with a player, whether or not to disassociate a player from an SBPU, whether or not a game outcome condition has been met, and so forth, and present such information to the server, which may track the information in a database. When a player begins play on a new gaming machine, for example, the gaming machine may query the server for information regarding any SBPUs which are associated with the player and which may be relevant to the game which the player might wish to play on the gaming machine. The gaming machine may then provide the player with access to such SBPUs.

In some other implementations, the gaming machines may act as conduits for game information and may not make determinations regarding SBPUs on their own. Instead, the server may evaluate the data and make determinations as to whether or not to associate an SBPU with a player, whether or not to disassociate a player from an SBPU, whether or not a game outcome condition has been met, and so forth. The server may then communicate instructions to the gaming machine indicating which SBPUs should currently be available to a player based on the associations which are tracked by the server. The server may also communicate instructions to the gaming machine indicating that a player should no longer be presented with an SBPU when the SBPU is disassociated from the player. In some implementations, the server may also communicate information to a gaming machine indicating how an SBPU is to be implemented, what the game outcome conditions are, or other SBPU-related data. One benefit of a centralized approach such as that described above is that game outcome conditions, power-up conditions, and other SBPU-related data may be changed rapidly at a central source rather than requiring an update of every machine which may provide SBPUs.

In some implementations, SBPUs may be handled using databases which include records which link SBPUs with players. The records may also, in some further implementations, indicate whether or not the player is to be associated with the SBPU. In some implementations, the database may also include records which identify one or more in-game advantages associated with each SBPU, as well as in which games an SBPU may be used (or not used), which game outcome conditions apply to the SBPU, and so forth.

Figure 5:
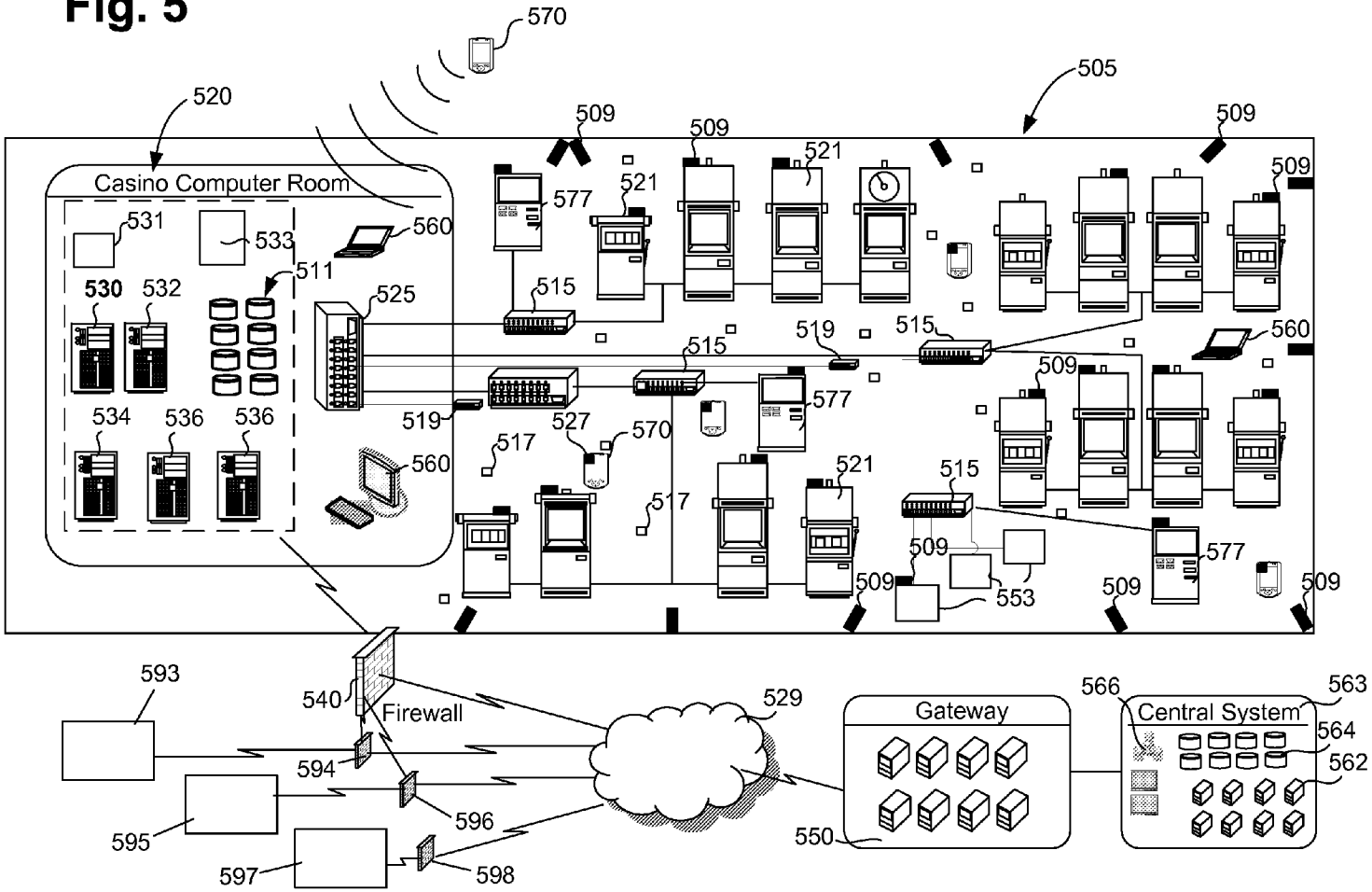
FIG. 5 depicts a high-level conceptual schematic of a wager gaming system which may be used to implement the techniques described herein.

FIG. 5 shows a server-based (Sb™) gaming network which may be used to implement some implementations described above. Those of skill in the art will realize that this architecture and the related functionality are merely examples and that the present disclosure encompasses many other such implementations and methods.

Here, casino computer room 520 and networked devices of a gaming establishment 505 are illustrated. Gaming establishment 505 is configured for communication with central system 563 via gateway 550. Gaming establishments 593 and 595 are also configured for communication with central system 563. Casino computer room 520 may, for example, house equipment such as that shown in remote site 310 in FIG. 3.

In some implementations, gaming establishments may be configured for communication with one another. In this example, gaming establishments 593 and 595 are configured for communication with casino computer room 520. Such a configuration may allow devices and/or operators in casino 505 to communicate with and/or control devices in other casinos. In some such implementations, a server in computer room 520 may control devices in casino 505 and devices in other gaming establishments. Conversely, devices and/or operators in another gaming establishment may communicate with and/or control devices in casino 505. Such systems may allow for an SBPU management system to communicate across casinos and allow for SBPUs to travel from one casino property to another.

Here, gaming establishment 597 is configured for communication with central system 563, but is not configured for communication with other gaming establishments. Some gaming establishments (not shown) may not be in communication with other gaming establishments or with a central system. Gaming establishment 505 includes multiple gaming machines 521, each of which is part of a bank 510 of gaming machines 521. Gaming machines 521 may, for example, be similar to gaming machine 2 of FIGS. 1A-1C, and may be used to allow players to request the redemption of SBPUs. In this example, gaming establishment 505 also includes a bank of networked gaming tables 553. However, the present disclosure may be implemented in gaming establishments having any number of gaming machines, gaming tables, etc. It will be appreciated that many gaming establishments include hundreds or even thousands of gaming machines 521 and/or gaming tables 553, not all of which are necessarily included in a bank and some of which may not be connected to a network. At least some of gaming machines 521 and/or mobile devices 570 may be "thin clients" that are configured to perform client-side methods as described elsewhere herein.

Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 553 may be configured for communication with individual player terminals (not shown), which may be configured to accept bets, present an electronic representation of a dealer, indicate game outcomes, etc.

Gaming establishment 505 also includes networked kiosks 577. Depending on the implementation, kiosks 577 may be used for various purposes, including but not limited to cashing out, prize redemption, redeeming points from a player loyalty program, redeeming "cashless" indicia such as bonus tickets, smart cards, etc. In some implementations, kiosks 577 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present disclosure. For example, in some implementations of the disclosure, kiosks 577 may be configured to receive information from a patron, e.g., such as temporary IDs.

In this example, each bank 510 has a corresponding switch 515, which may be a conventional bank switch in some implementations. Each switch 515 is configured for communication with one or more devices in computer room 520 via main network device 525, which combines switching and routing functionality in this example. Although various communication protocols may be used, some preferred implementations use the Gaming Standards Association's G2S Message Protocol. Other implementations may use IGT's open, Ethernet-based SuperSAS® protocol, which IGT makes available for downloading without charge. Still other protocols, including but not limited to Best of Breed ("BOB"), may be used to implement various implementations of the disclosure. IGT has also developed a gaming-industry-specific transport layer called CASH that rides on top of TCP/IP and offers additional functionality and security.

Here, gaming establishment 505 also includes an RFID network, implemented in part by RFID switches 519 and multiple RFID readers 517. An RFID network may be used, for example, to track objects (such as mobile gaming devices 570, which include RFID tags 527 in this example), patrons, etc., in the vicinity of gaming establishment 505.

As noted elsewhere herein, some implementations of the disclosure may involve "smart" player loyalty instruments, such as player tracking cards, which include an RFID tag. Accordingly, the location of such RFID-enabled player loyalty instruments may be tracked via the RFID network. In this example, at least some of mobile devices 570 may include an RFID tag 527, which includes encoded identification information for the mobile device 570. Accordingly, the locations of such tagged mobile devices 570 may be tracked via the RFID network in gaming establishment 505. Other location-detection devices and systems, such as the global positioning system ("GPS"), may be used to monitor the location of people and/or devices in the vicinity of gaming establishment 505 or elsewhere.

Various alternative network topologies can be used to implement different implementations of the disclosure and/or to accommodate varying numbers of networked devices. For example, gaming establishments with large numbers of gaming machines 521 may require multiple instances of some network devices (e.g., of main network device 525, which combines switching and routing functionality in this example) and/or the inclusion of other network devices not shown in FIG. 5. Some implementations of the disclosure may include one or more middleware servers disposed between kiosks 577, RFID switches 519 and/or bank switches 515 and one or more devices in computer room 520 (e.g., a corresponding server). Such middleware servers can provide various useful functions, including but not limited to the filtering and/or aggregation of data received from switches, from individual gaming machines and from other devices. Some implementations of the disclosure include load-balancing methods and devices for managing network traffic.

Storage devices 511, Sb™ server 530, License Manager 531, Arbiter 533, servers 532, 534, 536 and 538, host device (s) 560 and main network device 525 are disposed within computer room 520 of gaming establishment 505. In practice, more or fewer devices may be used. Depending on the implementation, some such devices may reside in gaming establishment 505 or elsewhere.

One or more devices in central system 563 may also be configured to perform, at least in part, tasks specific to the present disclosure. For example, one or more servers 562, arbiter 533, storage devices 564 and/or host devices 560 of central system 563 may be configured to implement the functions described in detail elsewhere herein. These functions may include, but are not limited to, providing functionality for devices such as wager gaming machines 521, mobile devices 570, etc.

One or more of the servers of computer room 520 may be configured with software for receiving a player's wager gaming notification parameters, determining when a wagering condition corresponds with the wager gaming notification parameters and/or providing a notification to the player when the wagering condition corresponds with the wager gaming notification parameters. Moreover, one or more of the servers may be configured to receive, process and/or provide image data from cameras 509, to provide navigation data to patrons (e.g., to indicate the location of and/or directions to a gaming table, a wager gaming machine, etc., associated with a wager gaming notification), etc. One or more of the servers of computer room 520 may also be configured to provide functionality similar to that provided by player tracking server 315, power-up management server 320, play management server 325, and external communications server 330 of FIG. 3.

For example, navigation data (which may include map data, casino layout data, camera image data, etc.) may be provided by one or more of the servers of computer room 520 to mobile devices 570. Some implementations of the present disclosure include a plurality of networked cameras 509, which may be video cameras, smart cameras, digital still cameras, etc. In some such implementations, such cameras may provide, at least in part, real-time navigation.

Other devices that may be deployed in network 505 do not appear in FIG. 5. For example, some gaming networks may include not only various radio frequency identification ("RFID") readers 517, but also RFID switches, middleware servers, etc., some of which are not depicted in FIG. 5. These features may provide various functions. For example, a server (or another device) may determine a location of a mobile device 570 according to the location of an RFID reader that reads an RFID tag 527.

The servers and other devices indicated in FIG. 5 may be configured for communication with other devices in or outside of gaming establishment 505, such as host devices 560, kiosks 577 and/or mobile devices 570, for implementing some methods described elsewhere herein. Servers (or the like) may facilitate communications with such devices, receive and store patron data, provide appropriate responses, etc., as described elsewhere herein.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the disclosure provide one or more of these servers in the form of blade servers.

Some implementations of Sb™ server 530 and the other servers shown in FIG. 5 include (or are at least in communication with) clustered CPUs, redundant storage devices, including backup storage devices, switches, etc. Such storage devices may include a "RAID"(originally redundant array of inexpensive disks, now also known as redundant array of independent disks) array, back-up hard drives and/or tape drives, etc.

In some implementations of the disclosure, many of these devices (including but not limited to License Manager 531, servers 532, 534, 536, and 538, and main network device 525) are mounted in a single rack with Sb™ server 530. Accordingly, many or all such devices will sometimes be referenced in the aggregate as an "Sb™ server." However, in alternative implementations, one or more of these devices is in communication with Sb™ server 530 and/or other devices of the network but located elsewhere. For example, some of the devices could be mounted in separate racks within computer room 520 or located elsewhere on the network. Moreover, it can be advantageous to store large volumes of data elsewhere via a storage area network ("SAN").

Computer room 520 may include one or more operator consoles or other host devices that are configured for communication with other devices within and outside of computer room 520. Such host devices may be provided with software, hardware and/or firmware for implementing various implementations of the disclosure. However, such host devices need not be located within computer room 520. Wired host devices 560 (which are desktop and laptop computers in this example) and wireless devices 570 (which are PDAs in this example) may be located elsewhere in gaming establishment 505 or at a remote location.

These and other aspects of the disclosure may be implemented by various types of hardware, software, firmware, etc. For example, some features of the disclosure may be implemented, at least in part, by machine-readable media that include program instructions, state information, etc., for performing various operations described herein. Examples of program instructions include both machine code, such as produced by a compiler, and files containing higher-level code that may be executed by the computer using an interpreter. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices ("ROM") and random access memory ("RAM").

Any of the above implementations may be used alone or together with one another in any combination. Although various implementations may have been motivated by various deficiencies with the prior art, which may be discussed or alluded to in one or more places in the specification, the implementations do not necessarily address any of these deficiencies. In other words, different implementations may address different deficiencies that may be discussed in the specification. Some implementations may only partially address some deficiencies or just one deficiency that may be discussed in the specification, and some implementations may not address any of these deficiencies.

While various implementations have been described herein, it should be understood that they have been presented by way of example only, and not limitation. Thus, the breadth and scope of the present application should not be limited by any of the implementations described herein, but should be defined only in accordance with the following and later-submitted claims and their equivalents.

It will be understood that unless features in any of the above-described implementations are expressly identified as incompatible with one another or the surrounding context implies that they are mutually exclusive and not readily combinable in a complementary and/or supportive sense, the totality of this disclosure contemplates and envisions that specific features of those implementations can be selectively combined to provide one or more comprehensive, but slightly different, technical solutions. It will therefore be further appreciated that the above description has been given by way of example only and that modifications in detail may be made within the scope of the invention.

What is claimed is:

1. A state-based power-up management server comprising:
a communications interface;
a memory; and
a logic device, wherein the logic device, the memory, and the communications interface are operably connected and configured to:
associate a state-based power-up with a player in a database stored in memory based on a determination that a power-up condition has been met during wagering game play;
receive a first input via the communications interface indicating that the state-based power-up has been redeemed for an in-game advantage at a first time during wagering game play and that a game outcome condition has been met in association with the redemption of the state-based power-up at the first time,
determine, responsive to receipt of the first input, that the association of the state-based power-up with the player is to be maintained as a result of the game outcome condition being met in association with the redemption of the state-based power-up at the first time, and
maintain, responsive to the determination that the association of the state-based power-up with the player is to be maintained, the association of the state-based power-up with the player in the database stored in the memory at least until a second input is received via the communications interface indicating that the state-based power-up has been redeemed for the in-game advantage at a second time later than the first time, wherein:
the power-up condition is different from the game outcome condition;
the state-based power-up is re-usable if the game outcome condition is met, and
the in-game advantage provides an opportunity to improve a score or chances of winning within a game.

2. The state-based power-up management server of claim 1, wherein the logic device, the memory, and the communications interface are further configured to:
receive the second input via the communications interface, the second input further indicating that the game outcome condition has not been met in association with the redemption of the state-based power-up at the second time;
determine, responsive to receipt of the second input, that the state-based power-up is to be disassociated from the player as a result of the game outcome condition not being met in association with the redemption of the state-based power-up at the second time;

disassociate, responsive to the determination that the state-based power-up is to be disassociated from the player, the state-based power-up from the player in the database stored in the memory; and communicate, to a wager gaming machine and via the communications interface, that the state-based power-up has been disassociated from the player in response to receiving the second input.

3. The state-based power-up management server of claim 2, wherein the logic device, the memory, and the communications interface are further configured to:

receive, via the communications interface, one or more additional inputs indicating that the state-based power-up has been redeemed at one or more additional times between the first time and the second time for the in-game advantage and that the game outcome condition has been met in association with each of the redemptions of the state-based power-up at the one or more additional times;

determine, responsive to receipt of the one or more additional inputs, that the association of the state-based power-up with the player is to be maintained as a result of the game outcome condition being met in association with the redemption of the state-based power-up at the one or more additional times; and maintain the association of the state-based power-up with the player in the database stored in the memory until the second input is received.

4. The state-based power-up management server of claim 1, wherein the logic device, the memory, and the communications interface are further configured to evaluate data included in the first input to determine that the game outcome condition has been met.

5. The state-based power-up management server of claim 1, wherein the first input includes a determination by a wager gaming machine that the game outcome condition has been met, and the logic device, the memory, and the communications interface are further configured to determine that the association of the state-based power-up with a player is to be maintained based on the determination by the wager gaming machine.

6. The state-based power-up management server of claim 1, wherein the logic device, the memory, and the communications interface are further configured to retrieve data regarding the in-game advantage from the database and communicate the data regarding the in-game advantage to a wager gaming machine.

7. The state-based power-up management server of claim 6, wherein the logic device, the memory, and the communications interface are further configured to:

change the in-game advantage during the wagering game play; and communicate data indicating the changed in-game advantage to the wager gaming machine via the communications interface.

8. The state-based power-up management server of claim 2, wherein the logic device, the memory, and the communications interface are further configured to:

change the in-game advantage between wagering game play on a second wager gaming machine and the wagering game play on the wager gaming machine, the wagering game play on the second gaming machine different than the wagering game play on the wager gaming machine; and communicate data indicating the changed in-game advantage to the wager gaming machine via the communications interface.

9. The state-based power-up management server of claim 2, wherein the logic device, the memory, and the communications interface are further configured to disassociate the state-based power-up from the player in the database by changing a flag in a record linking the state-based power-up with the player.

10. The state-based power-up management server of claim 2, wherein the logic device, the memory, and the communications interface are further configured to disassociate the state-based power-up from the player in the database by deleting a record in the database linking the state-based power-up with the player.

11. Computer software embodied in a non-transitory computer readable medium, the computer software including instructions for controlling devices in a gaming network, the gaming network including a server, a storage device communicatively connected to the server, and a gaming machine, to:

associate, by the server, a state-based power-up with a player in a database stored on the storage device based on a determination that a power-up condition has been met during wagering game play;

receive, by the server, a first input from the gaming machine via the gaming network indicating that the state-based power-up has been redeemed for an in-game advantage at a first time during wagering game play provided by the wager gaming machine and that a game outcome condition has been met in association with the redemption of the state-based power-up at the first time, determine, by the server and responsive to receipt of the first input by the server, that the association of the state-based power-up with the player is to be maintained as a result of the game outcome condition being met in association with the redemption of the state-based power-up at the first time, and maintain, by the server and responsive to the determination that the association of the state-based power-up with the player is to be maintained, the association of the state-based power-up with the player in the database stored on the storage device at least until a second input is received via the communications interface indicating that the state-based power-up has been redeemed for the in-game advantage at a second time later than the first time, wherein:

the power-up condition is different from the game outcome condition;

the state-based power-up is re-usable if a game outcome condition is met, and the in-game advantage provides an opportunity to improve a score or chances of winning within a game.

12. The non-transitory computer readable medium of claim 11, wherein the computer software further includes instructions for controlling the devices in the gaming network to:

receive, by the server, the second input via the gaming network indicating that the state-based power-up has been redeemed for the in-game advantage at the second time, the second input further indicating that the game outcome condition has not been met in association with the redemption of the state-based power-up at the second time;

determine, by the server and responsive to receipt of the second input, that the state-based power-up is to be disassociated from the player as a result of the game outcome condition not being met in association with the redemption of the state-based power-up at the second time;

disassociate, by the server and responsive to the determination that the state-based power-up is to be disassociated from the player, the state-based power-up from the player in the database stored on the storage device; and transmit, from the server and via the gaming network, information indicating that the state-based power-up has been disassociated from the player in response to receiving the second input.

13. The non-transitory computer readable medium of claim 12, wherein the computer software further includes instructions for controlling the devices in the gaming network to:

receive, by the server, one or more additional inputs indicating that the state-based power-up has been redeemed at one or more additional times between the first time and the second time for the in-game advantage and that the game outcome condition has been met in association with each of the redemptions of the state-based power-up at the one or more additional times;

determine, by the server and responsive to receipt of the one or more additional inputs, that the association of the state-based power-up with the player is to be maintained as a result of the game outcome condition being met in association with the redemption of the state-based power-up at the one or more additional times; and maintain, by the server, the association of the state-based power-up with the player in the database stored on the storage device until the second input is received.

14. The non-transitory computer readable medium of claim 11, wherein the computer software further includes instructions for controlling the server to evaluate data included in the first input to determine that the game outcome condition has been met.

15. The non-transitory computer readable medium of claim 11, wherein the first input includes a determination by the wager gaming machine that the game outcome condition has been met, and wherein the computer software further includes instructions for controlling the server to determine that the association of the state-based power-up with a player is to be maintained based on the determination by the wager gaming machine.

16. The non-transitory computer readable medium of claim 11, wherein the computer software further includes instructions for controlling the server to retrieve data regarding the in-game advantage from the database and communicate the data regarding the in-game advantage to the wager gaming machine.

17. The non-transitory computer readable medium of claim 16, wherein the computer software further includes instructions for controlling the server to:

change the in-game advantage during the wagering game play; and communicate data indicating the changed in-game advantage to the wager gaming machine or a second gaming machine via the communications interface.

18. The non-transitory computer readable medium of claim 12, wherein the computer software further includes instructions for controlling the server to:

change the in-game advantage between the wagering game play on the wager gaming machine and wagering game play on a different wager gaming machine, the wagering game play on the different gaming machine different than the wagering game play on the wager gaming machine; and communicate data indicating the changed in-game advantage to the different wager gaming machine via the communications interface.

19. The non-transitory computer readable medium of claim 16, wherein the computer software further includes instructions for controlling the server to disassociate the state-based power-up from the player in the database by changing a flag in a record linking the state-based power-up with the player.

20. The non-transitory computer readable medium of claim 16, wherein the computer software further includes instructions for controlling the server to disassociate the state-based power-up from the player in the database by deleting a record in the database linking the state-based power-up with the player.

* * * * *